US006749891B2

(12) United States Patent
Shiraishi et al.

(10) Patent No.: US 6,749,891 B2
(45) Date of Patent: Jun. 15, 2004

(54) ZINC OXIDE VARISTOR AND METHOD OF MANUFACTURING SAME

(75) Inventors: Kaori Shiraishi, Osaka (JP); Tatsuya Inoue, Osaka (JP); Riho Sasaki, Osaka (JP); Keiichi Noi, Osaka (JP); Hideaki Tokunaga, Hokkaido (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 32 days.

(21) Appl. No.: 10/196,939

(22) Filed: Jul. 18, 2002

(65) Prior Publication Data

US 2003/0043013 A1 Mar. 6, 2003

Related U.S. Application Data

(62) Division of application No. 09/941,929, filed on Aug. 30, 2001, now abandoned.

(51) Int. Cl.[7] ..... B05D 5/12; H01C 17/00

(52) U.S. Cl. ..... 427/101; 427/372.2; 29/610.1; 29/612; 29/619

(58) Field of Search ..... 427/101, 372.2; 29/610.1, 612, 619

(56) References Cited

U.S. PATENT DOCUMENTS 5,225,111 A * 7/1993 Imai ..... 252/19.52
6,260,258 B1 * 7/2001 Tokunaga et al. ..... 29/612

FOREIGN PATENT DOCUMENTS

| | | |
|---|---|---|
| EP | 0 866 474 A1 | 9/1998 |
| JP | 03173402 | 7/1991 |
| JP | 08124720 | 5/1996 |

* cited by examiner

*Primary Examiner*—Brian K. Talbot
(74) *Attorney, Agent, or Firm*—McDermott, Will & Emery

(57) ABSTRACT

A precipitate film having plating resistance may be formed on the surface of a varistor element during sintering process. Accordingly, the manufacturing process can be shortened, thereby improving the productivity. The manufacturing method comprises (a) a first process of forming the varistor element whose main component is zinc oxide; (b) a second process of sintering the varistor element and precipitating zinc compound having at least one of acid resistance and alkali resistance on the surface of the varistor. Preferably, the manufacturing method further comprises (c) a process of attaching an external electrode to the varistor element, and the external electrode attaching process is executed after finishing the varistor element sintering process.

23 Claims, 3 Drawing Sheets

ZINC OXIDE VARISTOR AND METHOD OF MANUFACTURING SAME

This application is a divisional of application Ser. No. 09/941,929 filed Aug. 30, 2001 now ABN.

FIELD OF THE INVENTION

The present invention relates to a zinc oxide varistor which absorbs dielectric lightning surge, electrostatic surge, burst surge or the like, and a method of manufacturing same.

BACKGROUND OF THE INVENTION

As a conventional zinc oxide varistor, the following zinc oxide varistor is generally known.

First, a material based on zinc oxide is sintered to make a varistor element. A first external electrode is formed on the surface of the sintered varistor element. Next, the varistor element is buried into a mixture based on $SiO_2$ and is subjected to heat treatment. Thus, $Zn_2SiO_4$ film having acid and alkali resistance is formed on the surface of the varistor element. To have acid and alkali resistance means to have plating resistance. Then, $Zn_2SiO_4$ film is also formed on the first external electrode, resulting in generation of irregularities thereon. In order to eliminate such irregularities and to assure electrical connection with external circuits, a second external electrode is formed on the first external electrode. After that, Ni plating and solder plating are performed on the second external electrode.

However, in the conventional configuration as described above, it is necessary, after forming the first external electrode, to again perform heat treatment in $SiO_2$, to remove deposits, and to form the secondary external electrode. Accordingly, there has been a problem that the manufacturing process becomes very complicated.

In order to solve such problem, the present invention is intended to provide a zinc oxide varistor having a $Zn_2SiO_4$ film on the surface of the varistor element, requiring no heat treatment in $SiO_2$ after forming the first external electrode, that is, after sintering the varistor element.

SUMMARY OF THE INVENTION

A method of manufacturing a zinc oxide varistor of the present invention comprises:

(a) a first process of forming a varistor element whose main component is zinc oxide, and (b) a second process of sintering the varistor element, wherein by sintering the varistor element, the varistor element is sintered, and zinc compound having at least one of acid resistance and alkali resistance is precipitated and formed on the surface of the varistor element.

Preferably, the method of manufacturing the zinc oxide varistor further comprises:

(c) a process of attaching an external electrode to the varistor element, wherein the external electrode attaching process is performed after finishing the process of sintering the varistor element.

A zinc oxide varistor of the present invention comprises:

a varistor element whose main component is zinc oxide; and a precipitate film formed on the surface of the varistor element;

wherein the precipitate film is more excellent in alkali resistance or acid resistance than the varistor element.

Preferably, the zinc oxide varistor further comprises an external electrode disposed on the surface of the varistor element.

By this configuration, a precipitate film having plating resistance may be formed on the surface of the varistor element during sintering process. As a result, it is possible to shorten the manufacturing process, and also, to improve the productivity. Plating resistance means that no deterioration occurs during plating process.

DETAILED DESCRIPTION OF THE INVENTION

Figure 1:
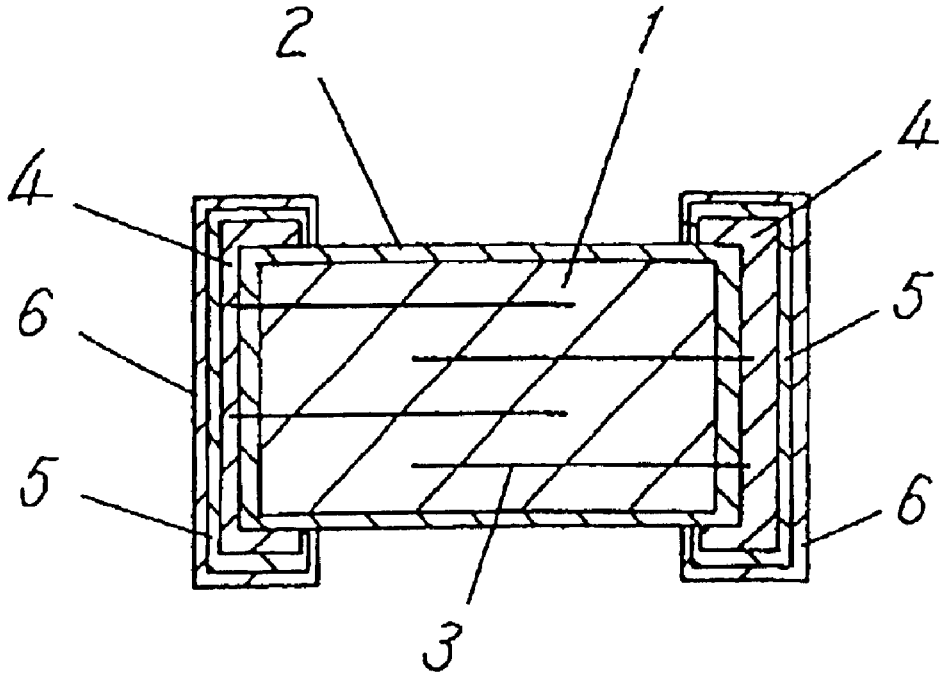
FIG. 1 is a sectional view of a laminate chip varistor being a zinc oxide varistor in an embodiment of the present invention.

A method of manufacturing a zinc oxide varistor of the present invention comprises:

(a) a first process of forming a varistor element whose main component is zinc oxide, and (b) a second process of sintering the varistor element, wherein by sintering the varistor element, the varistor element is sintered, and zinc compound having at least either acid resistance or alkali resistance is precipitated and formed on the surface of the varistor element.

By this configuration, it is possible to obtain a zinc oxide varistor having an acid or alkali resisting film on the surface of the varistor element without requiring heat treatment in $SiO_2$ after sintering the varistor element. Such acid or alkali resisting film is free from damage, breakage, and deterioration during plating process. That is, the acid or alkali resisting film ensures plating resistance. In the above manufacturing method, a precipitate film having plating resistance may be formed on the surface of a varistor element during sintering process. As a result, it is possible to shorten the manufacturing process, and also, to improve the productivity.

Preferably, in the first process, the varistor element further contains bismuth compound and silicon compound as sub-components. Thus, due to the bismuth compound, it is possible to promote the precipitation of zinc compound film on the varistor element surface during sintering process. As a result, a zinc oxide varistor having plating resistance can be obtained.

Preferably, the second process includes a step of precipitating Zn—Si—O based compound as zinc compound. Thus, Zn—Si—O based compound is produced in the varistor element, and consequently, a zinc oxide varistor having plating resistance can be obtained.

Preferably, the silicon compound contained ranges from 1 mol % to 15 mol % in terms of Si. Thus, it is possible to precipitate Zn—Si—O based compound having plating resistance on the varistor element surface without causing hindrance to the sintering effect.

Preferably, the sintering temperature in the second process ranges from 1000° C. to 1400° C. Thus, it is possible to precipitate Zn—Si—O based compound having plating resistance on the surface thereof and to obtain a zinc oxide varistor having the desired electric characteristics.

Preferably, in the first process, the varistor element further contains aluminum compound as a sub-component. Thus, it is possible to reduce generation of irregularities on the varistor element surface and to lessen the portion where Zn—Si—O based compound is not precipitated.

Preferably, the aluminum compound is contained by 3 mol % or less. Thus, it is possible to suppress the generation of irregularities on the varistor element surface and to lessen the portion where Zn—Si—O based compound is not precipitated.

Preferably, in the second process, the bismuth compound is disposed around the varistor element when the varistor element is sintered. Thus, the bismuth compound disposed around the varistor element is scattered during sintering and some of the scattered bismuth compound sticks to the surface of the varistor element during the temperature lowering process. Accordingly, it is possible to promote the precipitation of Zn—Si—O based compound onto the surface thereof the same as for the bismuth component in the varistor element.

Preferably, during sintering in the second process, the temperature becomes lowered at a speed so as to suppress the grain growth of the varistor element. Thus, it is possible to suppress the generation of irregularities on the surface of the varistor element and to lessen the portion where Zn—Si—O based compound is not precipitated.

Preferably, the silicon compound used is $Zn_2SiO_4$. Thus, it is possible to efficiently precipitate Zn—Si—O based compound on the surface of the varistor element during sintering process.

Preferably, the second process includes a step of storing the varistor element into a sheath and sintering same while rotating the sheath. Thus, even when a large quantity of varistor element is sintered, the heat distribution and the sintering atmosphere can be uniformed. As a result, it is possible to prevent variation in precipitation of zinc compound having plating resistance.

Preferably, the sheath stores at least one powder selected from the group consisting of $Al_2O_3$, MgO, $ZrO_2$, ZnO and NiO together with the varistor element. Thus, it is possible to prevent varistor elements from sticking to each other during sintering process.

Preferably, the first process includes a step of obtaining a mixture by mixing the main component and the sub-component before forming the varistor element, and then a step of calcining the mixture. Thus, due to calcining, zinc compound may be precipitated as previously intended. And, during sintering process, zinc compound can be efficiently precipitated on the surface of the varistor element.

Preferably, in the first process, the varistor element further contains bismuth compound and antimony compound as sub-components, and the second process includes a step of precipitating Zn—Sb—O based compound as zinc compound. Thus, it is possible to produce Zn—Sb—O based compound in the varistor element by sintering, and to promote film precipitation on the surface of the varistor element by bismuth compound. As a result, zinc oxide varistor having plating resistance can be obtained.

Preferably, the antimony compound is contained in a range from 1 mol % to 10 mol % in terms of Sb. The antimony compound is contained in a range of 1 mol % to 10 mol % in terms of Sb. Thus, it is possible to precipitate Zn—Sb—O based compound having plating resistance on the surface of the varistor element without causing hindrance to the sintering effect.

Preferably, in the first process, the varistor element further contains aluminum compound as a sub-component. Thus, it is possible to suppress the generation of irregularities on the surface of the varistor element and to lessen the portion where Zn—Si—O based compound is not precipitated.

Preferably, the aluminum compound is contained by 3 mol % or less. Thus, it is possible to suppress the generation of irregularities on the surface of the varistor element and to lessen the portion where Zn—Si—O based compound is not precipitated.

Preferably, a method of manufacturing a zinc oxide varistor of the present invention further comprises:

(c) a process of attaching an external electrode to the varistor element, wherein the external electrode attaching process is executed after finishing the step of sintering the varistor element.

Preferably, the external electrode attaching process includes a step of disposing an external electrode material, and a step of forming a plated layer by a plating method on the surface of the external electrode material.

Preferably, the plated layer contains at least two layers which have the nickel layer and one of tin layer and solder layer on the nickel layer.

Preferably, the process of forming the varistor element includes a step of forming a laminate varistor element having an internal electrode in the varistor element.

Preferably, the process of forming the varistor element includes:

a step of manufacturing a plurality of sheet varistor materials;

a step of disposing internal electrodes on the surface of each sheet varistor material; and a step of laminating the sheet varistor materials respectively having the internal electrodes.

Preferably, the first process includes:

(i) a step of preparing a mixture by mixing ZnO as main component, $SiO_2$ and at least one selected from the group consisting of $Bi_2O_3$, $Sb_2O_3$, $Co_3O_4$, $MnO_2$, NiO, $Cr_2O_3$ and Al $(NO_3)_3$ as sub-component, and (ii) a step of forming the mixture into a predetermined shape to form the varistor element, wherein the second process includes a step of precipitating Zn—Si—O based compound as zinc compound on the surface of the varistor element.

Preferably, the first process includes:

(i) a step of preparing a mixture by mixing ZnO as main component, $Sb_2O_3$ and at least one selected from the group consisting of $Bi_2O_3$, $Co_3O_4$, $MnO_2$, NiO, $Cr_2O_3$ and Al $(NO_3)_3$ as sub-component, and (ii) a step of forming the mixture into a predetermined shape to form the varistor element, wherein the second process includes a step of precipitating Zn—Sb—O based compound as zinc compound on the surface of the varistor element.

Preferably, the first process includes (iii) a step of calcining of the mixture;

(iv) a step of forming the temporarily burnt mixture into a predetermined size of the calcined powder; and (v) a step of preparing a slurry by using the calcined powder, wherein the slurry is used to form the varistor element into a predetermined shape.

Preferably, the first process includes:

(i) a step of preparing a mixture by mixing ZnO as main component and at least one of Zn—Si—O based compound and Zn—Sb—O based compound as sub-component;

(ii) a step of preparing a slurry by using the mixture; and (iii) a step of forming the mixture into a predetermined shape to form the varistor element, wherein the second process includes a step of precipitating at least either Zn—Si—O based compound or Zn—Sb—O based compound as zinc compound on the surface of the varistor element.

Preferably, in the second process, the zinc compound contains at least one of Zn—Si—O based compound and Zn—Sb—O based compound.

A zinc oxide varistor of the present invention comprises:

a varistor element whose main component is zinc oxide, and a precipitate film formed on the surface of the varistor element, wherein the precipitate film is more excellent in alkali resistance or acid resistance than the varistor element. Thus, it is possible to obtain a precipitate film having plating resistance on the surface of the varistor element without heat treatment in $SiO_2$ after sintering process.

Preferably, the precipitate film contains at least one of Zn—Zi—O based compound and Zn—Sb—O based compound. Thus, it is possible to further improve the plating resistance.

Preferably, the varistor element contains aluminum compound as sub-component. Thus, it is possible to suppress the generation of irregularities on the surface of the varistor element and to lessen the proportion where Zn—Si—O based compound is not precipitated.

Preferably, the varistor element includes an internal electrode disposed in the varistor element, and an external electrode disposed on the surface of the varistor element. The external electrode is electrically connected to the internal electrode. More preferably, the internal electrode is made of platinum. Thus, the percentage of contraction of the internal electrode becomes smaller. Further, zinc compound is precipitated out of the varistor element. Accordingly, it is possible to establish electrical connection between the internal electrode and the external electrode without executing a step of exposing the internal electrode after forming a precipitate film.

Preferably, the varistor element includes a plurality of varistor materials, a plurality of internal electrodes disposed inside the varistor materials, and external electrodes disposed on the surface of the varistor materials.

Preferably, the external electrode includes an external electrode material and a plated layer disposed on the surface of the external electrode material.

Preferably, the internal electrode includes a material whose main component is platinum, and the external electrode material includes at least one selected from the group consisting of Pt, Pt—Ag, Ag—Pd, and resin containing Ag.

Preferably, the plated layer includes contains at least two layers which have a nickel plated layer and one of a solder plated layer and a tin plated layer disposed on the nickel plated layer.

Exemplary Embodiment 1

A zinc oxide varistor in an exemplary embodiment of the present invention will be described in the following. FIG. 1 is a sectional view of a laminate chip varistor as a zinc oxide varistor.

In FIG. 1, varistor element 1 whose main component is zinc oxide has internal electrodes 3 whose main component is Pt. Also, precipitate film 2 whose main component is $Zn_2SiO_4$ is formed on the surface of the varistor element 1. External electrode 4 whose main component is Ag is disposed on the exposed ends of the internal electrodes 3. Further, Ni layer 5 and solder layer 6 are disposed on the external electrode 4.

Figure 2:
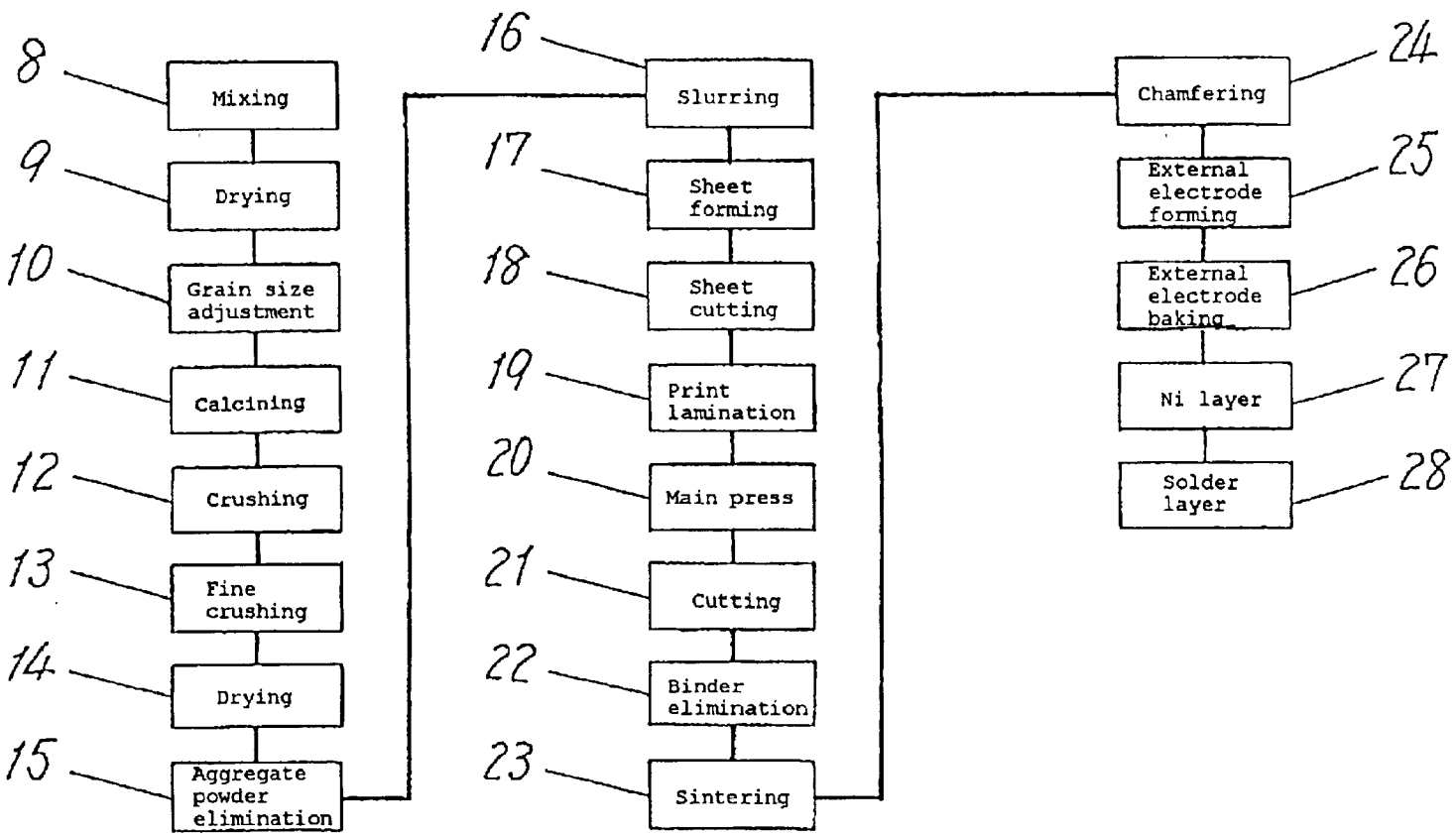
FIG. 2 shows a process of manufacturing a laminate chip varistor being a zinc oxide varistor in an embodiment of the present invention.

FIG. 2 is a manufacturing process chart of a laminate chip varistor in the present exemplary embodiment.

Figure 3:
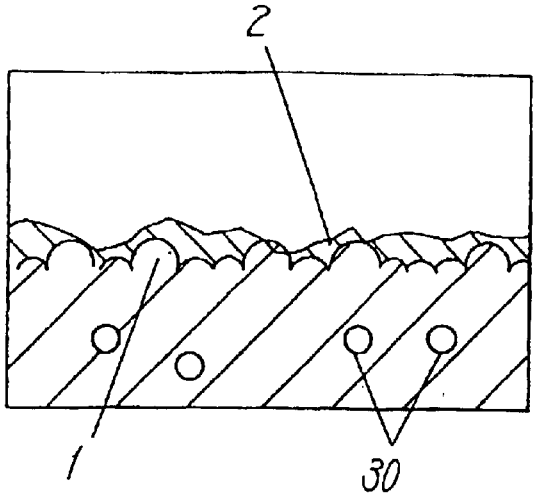
FIG. 3 is a view of varistor element grain size and precipitate film when aluminum compound is not added as a sub-component for a varistor element in an embodiment of the present invention.

FIG. 3 is a view of varistor element grain size and precipitate film when aluminum compound is not applied as a sub-component of the varistor element in the present embodiment.

Figure 4:
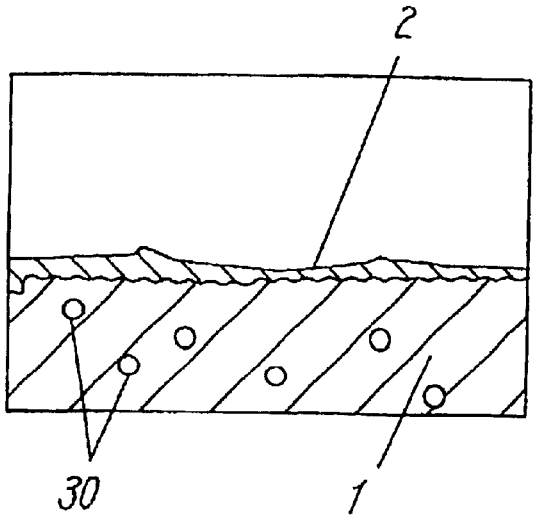
FIG. 4 is a view of varistor element grain size and precipitate film when aluminum compound is added as a sub-component for a varistor element in an embodiment of the present invention.

FIG. 4 is a view of varistor element grain size and precipitate film when aluminum compound is applied as a sub-component of the varistor element in the present embodiment. That is, FIG. 3 and FIG. 4 are sectional views that show the states of irregularities and precipitate film 2 formed on the surface of varistor element 1 with and without aluminum compound applied into the varistor element 1. In FIG. 3 and FIG. 4, $Zn_2SiO_4$ 30 is formed in the varistor element 1.

First, in the step No. 8 of FIG. 2, ZnO as main component and $SiO_2$, $Bi_2O_3$, $Sb_2O_3$, $Co_3O_4$, $MnO_2$, NiO, $Cr_2O_3$, Al $(NO_3)_3$ as sub-components are subjected to wet mixing. Next, the mixture is dried in the step No. 9. Thus, material powder may be obtained. In that case, if silicon compound is insufficient, precipitate film 2 cannot be formed on the surface of varistor element 1, and if silicon compound is excessive, it will affect the sintering effect. Accordingly, the quantity of silicon compound added is adjusted to 1 mol % to 15 mol % or preferably to 5 mol % to 10 mol % in terms of Si.

Also, in case of adding aluminum compound, it is possible to suppress the generation of irregularities on the surface of varistor element 1 and to lessen the portion where precipitate film 2 is not formed and to further improve the plating resistance.

The quantity of aluminum compound added is adjusted to 3 mol % max. or preferably to 1 mol % or less in terms of Al. Further, by adding aluminum compound, it is also possible to obtain the effect of improving the plating resistance inside the varistor element 1.

Next, in the step No. 10 of FIG. 2, dry powder grain size is adjusted. Subsequently, in the step No. 11 of FIG. 2, the powder is put into a sheath and is calcined at a temperature of 800° C. to 1000° C. After that, in the step No. 12 of FIG. 2, the calcined powder is crushed until becoming 1.0±0.5 $\mu$m in grain size on the average. Then, in case the crushed powder is smaller in grain size, the excellent life under high temperature is obtained, and the precipitation of $Zn_2SiO_4$ onto the surface of varistor element 1 can be promoted. And the powder is finely crushed in the step No. 13, and is sufficiently dried in the step No. 14. The powder is again crushed in the step No. 15, and then, powder of larger gain sizes is eliminated in order to obtain a uniform slurry.

Next, in the step No. 16, the crushed powder is mixed with butyl acetate as a solvent, benzene butyl phthalate as a plasticizer, and butyral resin as a binder, thereby manufacturing a slurry.

Subsequently, in the step No. 17, the slurry is formed into a sheet having a predetermined thickness by the doctor blade method after eliminating solid matters contained therein. After that, the sheet is cut to a predetermined shape in the step No. 18. And in the step No. 19, Pt paste as internal electrode 3 is printed thereon in a desired form, followed by lamination.

In that case, an electrode made of at least one metal out of Pt, Pd, and Ag can be used as the internal electrode.

After that, main press operation is performed in the step No. 20. And in the step No. 21, the work is cut to a predetermined shape. In this way, the varistor element 1 can be obtained.

Next, the varistor element 1 is inserted into a sheath for binder elimination, which is thrown into a binder eliminating furnace, and then the temperature is increased up to 400° C. at a temperature increasing rate of 25° C./h. The condition is maintained for two hours, and further, the temperature is increased up to 700° C., and the condition is maintained for two hours. Thus, the binder is eliminated in the step No. 22. The purpose of this is to provide the varistor element 1 with a sufficient strength in advance since it is necessary to rotate the sheath, storing the varistor element 1, in the next sintering process.

In the step No. 23, the varistor element 1 with the binder completely eliminated is put into a bullet-shape sheath together with $Al_2O_3$ powder, which is then thrown into a furnace and sintered in the air.

The sintering process is described in the following. First, the temperature is increased up to 800° C. at a temperature increasing rate of 200° C./h without rotating the sheath. After that, rotating the sheath is started at the temperature higher than 800° C. Subsequently, the temperature is increased up to 1000° C. to 1400° C. max. at a rate of 200° C./h, and the condition is maintained for two hours at the maximum temperature. Next, the temperature is lowered at a temperature lowering rate of 100° C./h.

In the step No. 24, chamfering of the varistor element 1 is performed. Subsequently, in the step No. 25, external electrode 4 whose main component is Ag is formed on the exposed ends of the internal electrodes 3. Next, in the step No. 26, baking is performed. In this case, the external electrode 4 is formed from a paste prepared by dispersing Ag in Pt, Pt—Ag, Ag—Pd, or thermosetting resin.

In the steps No. 27 and No. 28, the external electrode 4 is subjected to baking, followed by Ni-plating, and by solder plating. In this way, Ni layer 5 and solder layer 6 are formed. A laminate chip varistor is completed through such steps. It is also possible to perform Sn plating to form an Sn layer instead of solder plating.

Next, precipitate film 2 whose main component is $Zn_2SiO_4$, which is formed on the surface of the varistor element 1, is described in the following.

Zinc oxide is an amphoteric substance that dissolves in both acid and alkali. Therefore, zinc oxide dissolves in Ni plating solution and solder plating solution which are acidic or alkaline. A film containing $Zn_2SiO_4$ as main component is harder to dissolve in acidic and alkaline solution than the varistor element 1. Accordingly, by coating the surface of varistor element 1 with precipitate film 2 whose main component is $Zn_2SiO_4$, it is possible to suppress the intrusion of plating solution into the varistor element 1. Generally, when electrolytic plating is performed with the surface of varistor element 1 completely exposed, a metal flow is generated since the varistor element 1 is a semiconductor. However, in the present exemplary embodiment, it is possible to prevent generation of a metal flow because the precipitate film 2 having $Zn_2SiO_4$ as main component is a high resistance substance.

Also, in the present exemplary embodiment, $Sb_2O_3$ as a sub-component of varistor element 1 is also applied. Accordingly, Zn—Sb—O based compound is also produced due to sintering, and Zn—Sb—O based compound is precipitated on the surface of varistor element 1 together with $Zn_2SiO_4$. The Zn—Sb—O based compound also has excellent plating resistance the same as $Zn_2SiO_4$. Therefore, it is possible to obtain a varistor having excellent plating resistance which does not affect the plating effect.

Also, in case Sb compound is not applied as a sub-component of varistor element 1, Zn—Sb—O based compound will not be formed. However, even in case only $Zn_2SiO_4$ is applied, a laminate chip varistor having practically sufficient plating resistance can be obtained.

In the above embodiment, the material powder was calcined to form $Zn_2SiO_4$ in advance in order to promote the precipitation on the surface of varistor element 1 after calcining, but it is not limited to this configuration. It is also possible to use $Zn_2SiO_4$ as silicon compound instead of calcining. In this way, the same effect as described above may be obtained. Naturally, it is possible to form precipitate film 2 having $Zn_2SiO_4$ as main component on the surface of varistor element 1 without using $Zn_2SiO_4$ as silicon compound or without calcining of the material powder.

Further, as shown in FIG. 3, with advance of the grain growth of varistor element 1, the irregularities on the surface thereof increase in size, and as a result, there may be generated some portion where precipitate film 2 cannot be formed on the surface of varistor element 1. However, as shown in FIG. 4, with grain growth and generation of surface irregularities suppressed, it is possible to lessen the portion where precipitate film 2 is not formed on the surface of varistor element.

From the result of analysis, it is clear that the addition of aluminum compound as a sub-component of varistor element 1 increases the amount of substance of the spinel structure (e.g. Zn—Sb—O based compound, etc. in the present embodiment) existing at the triple point of grain boundary of varistor element 1, and the substance serves a wedge-like function to suppress the grain growth. As a result, as shown in FIG. 4, it has resulted in suppressing the generation of irregularities on the surface of varistor element 1 and lessening the portion where precipitate film 2 is not formed on the surface of varistor element 1. Thus, it is possible to further improve the plating effect and enhance the metal flow preventing effect.

Precipitate film 2 having $Zn_2SiO_4$ as main component can be formed on the surface of varistor element 1 without adding aluminum compound as a sub-component of varistor element 1. However, from the above result of analysis, it is clear that precipitate film 2 can be further reliably formed when aluminum compound is used as a sub-component of varistor element 1.

Also, it is possible to start the formation of $Zn_2SiO_4$ at a lower temperature when bismuth is added as a sub-component of varistor element 1. For example, in case of no bismuth, the reaction of $2ZnO+SiO_2 \rightarrow Zn_2SiO_4$ will not take place at a temperature lower than 1000° C. However, under the existence of bismuth, most of Si will become $Zn_2SiO_4$ at 1000° C. This phenomenon probably occurs in the course of the following reaction.

$$Bi_2O_3+SiO_2 \rightarrow Bi_4(SiO_4)_3,$$

$$Bi_4(SiO_4)_3+6ZnO \rightarrow 3Zn_2SiO_4+2Bi_2O$$

Further, the bismuth is liquefied and dispersed during sintering. Therefore, more bismuth will exist on the surface of varistor element 1. Accordingly, the precipitation of $Zn_2SiO_4$ onto the surface of varistor element 1 is promoted and $Zn_2SiO_4$ close to the surface of varistor element 1 also moves onto the surface, thereby lessening the portion where precipitate film 2 is not formed on the surface of varistor element 1.

Exemplary Embodiment 2

In a laminate chip varistor in the second exemplary embodiment, precipitate film 2 has Zn—Sb—O based compound as main component. The other configuration is same as in the laminate chip varistor in the first exemplary embodiment described above.

First, ZnO as main component and $Bi_2O_3$, $Sb_2O_3$, $Co_3O_4$, $MnO_2$, NiO, $Cr_2O_3$, and Al $(NO_3)_3$ as sub-components are subjected to wet mixing (No. 8 of FIG. 2), followed by drying (No. 9 of FIG. 2). Thus, the material powder is obtained. In that case, if the amount of antimony compound added is insufficient, precipitate film 2 cannot be formed on the surface of varistor element 1, and if the amount of antimony compound added is excessive, it will affect the sintering effect. Accordingly, the amount of antimony compound added is adjusted to 1 mol % to 10 mol % or preferably 4 mol % to 10 mol % in terms of Sb.

The same as in the first exemplary embodiment, varistor element 1 is obtained through the steps No. 10 to No. 21 of FIG. 2.

Next, the varistor element 1 is inserted into a sheath for binder elimination, which is thrown into a binder eliminating furnace, and then the temperature is increased up to 400° C. at a temperature increasing rate of 25° C./h, and the condition is maintained for two hours. After that, the temperature is further increased up to 700° C., and the condition is maintained for two hours. Thus, the binder is eliminated (No. 22 of FIG. 2). In this way, the strength of varistor element 1 is increased. And it is possible to prevent the varistor element 1 from being damaged when the sheath, storing the varistor element 1, is rotated in the next sintering process.

The varistor element 1 with the binder completely eliminated is put into a bullet-shape sheath together with $Al_2O_3$ powder, which is then thrown into a furnace and sintered in the air (No. 23 of FIG. 2).

The sintering process is described in the following. First, the temperature is increased up to 800° C. at a temperature increasing rate of 200° C./h without rotating the sheath. After that, the sheath rotation is started at a temperature higher than 800° C. Subsequently, the temperature is increased up to 1000° C. to 1400° C. max. at a rate of 200° C./h, and the condition is maintained for two hours at the maximum temperature. Next, the temperature is lowered at a temperature lowering rate of 100° C./h.

After the sintering process, the varistor element 1 is subjected to chamfering (No. 24 of FIG. 2). External electrode 4 whose main component is Ag is formed on the exposed ends of internal electrodes 3 (No. 25 of FIG. 2). After that, baking is performed (No. 26 of FIG. 2). In this case, the external electrode 4 is formed by using a paste prepared by dispersing Ag in Pt, Pt—Ag, Ag—Pd, or thermosetting resin.

After baking the external electrode 4, Ni plating is performed, followed by solder plating. Thus, Ni layer 5 and solder layer 6 are formed (No. 27, 28 of FIG. 2). In this way, a laminate chip varistor can be obtained.

It is also possible to form an Sn layer by performing Sn plating instead of solder plating.

Here, precipitate film 2 whose main component is Zn—Sb—O based compound, which is formed on the surface of varsistor element 1, will be described in the following.

Zinc oxide is an amphoteric substance that dissolves in both acid and alkali. Therefore, zinc oxide dissolves in Ni plating solution and solder plating solution which are acidic or alkaline. A film containing $Zn_2SiO_4$ as main component is harder to dissolve in acidic and alkaline solution than the varistor element 1. Accordingly, by coating the surface of varistor element 1 with precipitate film 2 whose main component is $Zn_2SiO_4$, it is possible to suppress the intrusion of plating solution into the varistor element 1. Generally, when electrolytic plating is performed with the surface of varistor element 1 completely exposed, a metal flow is generated since the varistor element 1 is a semiconductor. However, in the present exemplary embodiment, it is possible to prevent generation of such metal flow because the precipitate film 2 having $Zn_2SbO_4$ as main component is a high resistance substance.

In the above embodiment, the material powder was calcined to form Zn—Sb—O based compound in advance in order to promote the precipitation on the surface of varistor element 1 during burning, but it is not limited to this configuration. It is also possible to use Zn—Sb—O based compound as antimony compound instead of calcining. In this way, the same effect as described above may be obtained. Naturally, it is possible to form precipitate film 2 having Zn—Sb—O based compound as main component on the surface of varistor element 1 without using Zn—Sb—O based compound as antimony compound or without calcining of the material powder.

Also, precipitate film 2 in the second exemplary embodiment probably contains $Zn_{2.33}Sb_{0.67}O_4$ as main component. There exists a possibility that Zn—Sb—O based compound having another configuration is precipitated on the precipitate film 2. Therefore, it was expressed by precipitate film 2 having Zn—Sb—O as main component with respect to the precipitate film 2.

Further, in the second exemplary embodiment, it is possible to lessen the portion where precipitate 2 is not formed on the surface of varistor element 1 by suppressing the grain growth of varistor element and generation of irregularities on the surface. Accordingly, the same as in the first exemplary embodiment, the addition of aluminum compound as a sub-component of varistor element 1 increases the amount of substance of the spinel structure consisting of Zn and Sb and O, existing at the triple point of grain boundary of varistor element 1, and the substance of the spinel structure serves a wedge-like function to suppress the grain growth.

Further, by adding bismuth as a sub-component of varistor element 1, the same as in the first exemplary embodiment, it is possible to start the formation of Zn—Sb—O based compound at a lower temperature. Moreover, the bismuth is liquefied and dispersed during sintering. Therefore, more bismuth will exist on the surface of varistor element 1. In this case, preferably, the bismuth compound is being disposed around the varistor element when the varistor element is sintered. Accordingly, the precipitation of Zn—Sb—O based compound onto the surface of varistor element 1 is promoted, and also, Zn—Sn—O based compound close to the surface of varistor element 1 moves onto the surface. As a result, it is possible to lessen the portion where precipitate film 2 is not formed on the surface of varistor element 1.

Also, precipitate film 2 having Zn—Sb—O based compound as main component can be formed on the surface of varistor element 1 without adding aluminum compound as a sub-component of varistor element 1. However, in order to lessen as much as possible the portion where precipitate film 2 is not formed, it is desirable to add aluminum compound.

The points of the present invention will be described in the following.

(1) The role of precipitate film 2 of the present invention is to prevent intrusion of the plating solution into varistor element 1 in the plating process and also to prevent the generation of a metal flow. Accordingly, it is desirable that the whole surface of varistor element 1 be completely covered with precipitate film 2. In the present invention, the component of precipitate film 2 is precipitated out of the varistor element 1. Therefore, the whole surface of varistor element 1 cannot be completely covered with the film, and there may sometimes exist a portion where precipitate 2 is not formed as shown in FIG. 3.

However, such portion where precipitate film 2 is not formed will hardly cause the intrusion of plating solution and generation of a metal flow.

(2) When the varistor element 1 is sintered and the sheath is rotated, the varistor element 1 and $Al_2O_3$ can be well mixed by rotating the sheath with the rotary shaft kept in a horizontal position. Thus, it is possible to promote the formation of precipitate film 2 and also to prevent the variation of the forming status.

(3) When the varistor element 1 is sintered, $Al_2O_3$ powder is mixed in the sheath. In this case, it is also possible to apply at least one of $Al_2O_3$, MgO, $ZrO_2$, ZnO, and NiO powders together with the material powder of varistor element 1. Thus, the high temperature loading life can be improved since bismuth is adsorbed out of the varistor element 1. Further, it is possible to prevent the varistor elements 1 from sticking to each other as bismuth serves a function as adhesive when the temperature is lowered in the sintering process.

Further, when $Al_2O_3$ powder is used, the same effect as obtained by adding aluminum compound as a sub-component of varistor element 1 can be obtained. Accordingly, even when aluminum compound is not added as a sub-component of varistor element 1, by storing $Al_2O_3$ powder into the sheath together with the varistor element 1 before sintering, it is possible to decrease the irregularities on the surface of varistor element 1 and to lessen the portion where precipitate film 2 is not formed.

(4) In each of the above embodiments, when the varistor element 1 is sintered, the rotation of the sheath is started at a temperature higher than 800° C. It is not limited to this configuration, and the sheath rotation starting temperature is desirable to be in a range from 700° C. to 1000° C. Most preferably, it is desirable to start the rotation at a temperature around 800° C. Thus, it is possible to prevent cracking of the varistor element 1 and to disperse the bismuth as specified.

Also, the sheath is rotated in order to make uniform the atmosphere and temperature distribution inside the sheath. If the sheath rotating speed is too low, it will be difficult to make uniform the temperature distribution and atmosphere. If the rotating speed is too high, a greater damage will be given to the varistor element 1. Therefore, it is desirable to rotate the sheath at a speed ranging from 0.5 rpm to 5 rpm.

(5) In case the highest sintering temperature is lower than 1000° C., precipitate film 2 will not be formed enough to prevent intrusion of plating solution into varistor element 1 and to prevent generation of a metal flow. In case the highest sintering temperature exceeds 1400° C., precipitate film 2 is formed, but the electrical characteristics of the laminate chip varistor will be deteriorated or delamination will take place. Accordingly, the highest sintering temperature is desirable to be in a range from 1000° C. to 1400° C. and, preferably, in a range from 1000° C. to 1300° C.

(6) Taking into account the points that the grain growth is suppressed, the varistor element 1 becomes smaller and uniform in grain size, the surface of varistor element 1 is reduced in irregularity, and the portion where precipitate film 2 is not formed on the surface of varistor element 1 is lessened, the higher the temperature lowering rate in sintering process, the better and more desirable it is.

On the other hand, taking into account the life expectancy, that is one of the major characteristics of a laminate chip varistor, the lower the temperature lowering rate, the better it is.

Accordingly, in order to form precipitate film 2 capable of covering the whole surface of varistor element 1 as much as possible without affecting the electrical characteristics of the laminate chip varistor, it is desirable that the temperature lowering rate be in a range of 50° C./h to 400° C./h and, more preferably, in a range of 100° C./h to 200° C./h.

(7) Internal electrode 3 is formed by using at least one metal out of Pt, Pd, and Ag, as shown in the first exemplary embodiment. When Pt or a metal having Pt as main component is used, internal electrodes 3 are exposed at the ends of varistor element 1 after sintering. Accordingly, no grinding is needed for exposing the internal electrodes 3 after sintering process.

The reason for this is that the percentage of contraction of internal electrode 3 using Pt or a metal whose main component is Pt is very small. Or, the portion whose main component is ZnO becomes greater in percentage of contraction than the internal electrode 3 since precipitate film 2 is formed through reaction of the substance inside the varistor element 1.

Naturally, it is possible to form external electrode 4 before sintering. It is required that the external electrode 4 be formed of a metal which may function as an external electrode 4 even after heat treatment at the highest sintering temperature.

(8) In each of the above embodiments, the varistor element 1 was sintered in the air. However, from the result of experiments with the partial pressure of oxygen varied, it is clear that the lower the partial pressure of oxygen around the varistor element 1, the thicker the precipitate film 2 formed on the surface thereof, making it possible to improve the plating effect. However, due to sintering under the low partial pressure of oxygen, the laminate chip varistor characteristics may sometimes become deteriorated. In that case, the desired characteristics can be restored by performing heat treatment at 800° C. to 1000° C. again in the air.

(9) The above exemplary embodiments have referred to a laminated zinc oxide varistor. It is not limited to this type of varistor only, but a single-plate type varistor is also usable as a zinc oxide varistor of the present invention. In this case, it is also possible to reduce the manufacturing steps the same as in the laminate zinc oxide varistor.

As described above, by the present invention, a precipitate film whose main component is zinc compound having plating resistance can be formed on the surface of a varistor element without another heat treatment in $SiO_2$ after sintering. Accordingly, the manufacturing process can be shortened. As a result, it is possible to improve the productivity and, further, to reduce the cost.

What is claimed is:

1. A method of manufacturing a zinc oxide varistor comprising:

(a) a first process of forming a varistor element, said varistor element contains zinc oxide as a main component, and (b) a second process of sintering said varistor element, wherein by sintering said varistor element, said varistor element is sintered, and a zinc compound having at least one of acid resistance and alkali resistance is precipitated and formed on the surface of said varistor elements, wherein, in the first process, said varistor element further contains bismuth compound and silicon compound as sub-components, and the second process includes a step of precipitating Zn—Si—O based compound as at least part of the zinc compound, wherein said silicon compound is contained ranging from 1 mol % to 15 mol % in terms of Si, wherein the sintering temperature in the second process ranges from 1000° C. to 1400° C., wherein the second process includes a step of storing said varistor element into a sheath and sintering same while rotating said sheath, and wherein said sheath stores at least one powder selected from the group consisting of $Al_2O_3$, MgO, $ZrO_2$, ZnO and NiO together with said varistor element.

2. The method of manufacturing a zinc oxide varistor of claim 1, wherein, in the first process, said varistor element further contains aluminum compound as a sub-component.

3. The method of manufacturing a zinc oxide varistor of claim 2, wherein said aluminum compound is contained by 3 mol % or less.

4. The method of manufacturing a zinc oxide varistor of claim 1, wherein, in the second process, said bismuth compound is disposed around said varistor element when said varistor element is sintered.

5. The method of manufacturing a zinc oxide varistor of claim 1, wherein sintering in the second process includes a step of lowering a temperature at a speed so as to suppress a grain growth of said varistor element.

6. The method of manufacturing a zinc oxide varistor of claim 1, wherein said silicon compound is $Zn_2SiO_4$.

7. The method of manufacturing a zinc oxide varistor of claim 1, wherein the first process includes a step of obtaining a mixture by mixing the main component and the sub-component before forming said varistor element, and then a step of calcining said mixture.

8. The method of manufacturing a zinc oxide varistor of claim 1, wherein, in the first process, said varistor element further contains antimony compound as a sub-component, and the second process includes a step of precipitating Zn—Sb—O based compound as part of the zinc compound.

9. The method of manufacturing a zinc oxide varistor of claim 8, wherein the antimony compound is contained ranging from 1 mol % to 10 mol % in terms of Sb.

10. The method of manufacturing a zinc oxide varistor of claim 8, wherein, in the first process, said varistor element further contains aluminum compound as a sub-component.

11. The method of manufacturing a zinc oxide varistor of claim 10, wherein the aluminum compound is contained by 3 mol % or less.

12. The method of manufacturing a zinc oxide varistor of claim 1, further comprising:

(c) a process of attaching an external electrode to said varistor element, wherein said external electrode attaching process is executed after finishing said varistor element sintering process.

13. The method of manufacturing a zinc oxide varistor of claim 12, wherein the external electrode attaching process includes a step of disposing an external electrode material, and a step of forming a plated layer by a plating method on the surface of said external electrode material.

14. The method of manufacturing a zinc oxide varistor of claim 13, wherein the step of forming said plated layer includes the steps of disposing a nickel plated layer on the surface of said external electrode material, and disposing one of a tin layer and a solder layer on said nickel plated layer.

15. The method of manufacturing a zinc oxide varistor of claim 1, wherein the process of forming said varistor element includes a step of forming a laminate varistor element having internal electrodes in said varistor element.

16. The method of manufacturing a zinc oxide varistor of claim 1, wherein the process of forming said varistor element includes the steps of manufacturing a plurality of sheet varistor materials, disposing internal electrodes on the surface of each of said sheet varistor materials, and laminating said sheet varistor materials respectively having said internal electrodes.

17. The method of manufacturing a zinc oxide varistor of claim 16, further comprising:

(c) a process of attaching an external electrode to said varistor element, wherein said external electrode attaching process is executed after finishing said varistor element sintering process.

18. The method of manufacturing a zinc oxide varistor of claim 17, wherein said external electrode attaching process includes the steps of disposing an external electrode material, and forming a plated layer by a plating method on the surface of said external electrode material.

19. The method of manufacturing a zinc oxide varistor of claim 1, wherein said first process includes the steps of:

(i) preparing a mixture by mixing ZnO as a main component, $SiO_2$, $Bi_2O_3$ and at least one selected from the group consisting of [[$Bi_2O_3$,]] $Sb_2O_3$, $Co_3O_4$, $MnO_2$, NiO, $Cr_2O_3$, and Al $(NO_3)_3$ as sub-components, and (ii) forming the mixture into a predetermined shape to form said varistor element.

20. The method of manufacturing a zinc oxide varistor of claim 1, wherein said first process includes the steps of:

(i) preparing a mixture by mixing ZnO as a main component, $Bi_2O_3$, $Sb_2O_3$ and at least one selected from the group consisting of [[$Bi_2O_3$,]] $Co_3O_4$, $MnO_2$, NiO, $Cr_2O_3$, and Al $(NO_3)_3$ as sub-components, and (ii) forming said mixture into a predetermined shape to form said varistor element, wherein said second process includes a step of precipitating Zn—Sb—O based compound as part of the zinc compound.

21. The method of manufacturing a zinc oxide varistor of claim 19, wherein said first process further includes the steps of:

(iii) calcining said mixture;

(iv) forming said mixture, which is calcined, into a predetermined size of calcined powder; and (v) preparing a slurry by using said calcined powder, wherein said slurry is used to form said varistor element into a predetermined shape.

22. The method of manufacturing a zinc oxide varistor of claim 1, wherein said first process includes the steps of:

(i) preparing a mixture by mixing ZnO as a main component, $Bi_2O_3$, Zn—Si—O based compound and Zn—Sb—O based compound as sub-components;

(ii) preparing a slurry by using said mixture; and (iii) forming said mixture into a predetermined shape to form said varistor element, wherein said second process includes:

a step of precipitating Zn—Si—O based compound as part of the zinc compound.

23. The method of manufacturing a zinc oxide varistor of claim 1, wherein, in the second process, said zinc compound contains a Zn—Sb—O based compound.

* * * * *